US005901390A

United States Patent [19]

Williams

[11] Patent Number: 5,901,390

[45] Date of Patent: May 11, 1999

[54] SYSTEM FOR INSERTING AND REMOVING A BED PAN

[76] Inventor: Lavada G. Williams, 4023 Balfour Ave., Oakland, Calif. 94610-1753

[21] Appl. No.: 08/794,753

[22] Filed: Feb. 3, 1997

[51] Int. Cl.[6] ..... A61G 7/02

[52] U.S. Cl. ..... 5/604; 5/695; 4/476

[58] Field of Search ..... 5/604, 606, 695, 5/699; 4/449, 476, 483

[56] References Cited

U.S. PATENT DOCUMENTS

| | | | |
|---|---|---|---|
| 619,708 | 2/1899 | Angus | 5/695 |
| 963,538 | 7/1910 | Ford | 5/604 |
| 2,533,774 | 12/1950 | Delisi et al. | 5/604 |
| 3,849,811 | 11/1974 | Cyll | 5/604 |
| 4,334,330 | 6/1982 | Marshall | 5/604 |
| 4,847,932 | 7/1989 | Baribault, Jr. | 5/695 |

FOREIGN PATENT DOCUMENTS

| | | | |
|---|---|---|---|
| 1169414 | 11/1969 | United Kingdom | 5/604 |

*Primary Examiner*—Kenneth J. Dorner
*Assistant Examiner*—Robert G. Santos
*Attorney, Agent, or Firm*—Theodore J. Bielen, Jr.

[57] ABSTRACT

A system for inserting and removing a bed pan in conjunction with a bed, utilizing a vessel which is capable of holding human waste products. A track is supported by the bed and extends along and beneath the top surface of the bed. The track includes a guide for moving the vessel along the same. The vessel may be placed in the guide in a first position within the periphery of the bed and in a second position outwardly from the periphery of the bed. A conduit extends from the top surface of the bed to a place beneath the top surface of the bed for communication with the vessel when it is at the first position.

6 Claims, 1 Drawing Sheet

SYSTEM FOR INSERTING AND REMOVING A BED PAN

BACKGROUND OF THE INVENTION

The present invention relates to a novel and useful system for inserting and removing a bed pan.

Persons confined to a bed at home or in a hospital are inevitably faced with passing wastes into a bed pan. The present system is to require that the bed ridden person or an attendant position the bed pan beneath the bed ridden person to collect human waste. The attendant or bed ridden person must then remove the bed pan to the edge of the top surface of the bed for collection by another. In the alternative, not using a bed pan requires constant changing of wet sheets and bedding or the use of diapers on the bed ridden patient or person. Failure to timely change the diapers or sheets may further cause complications in chilling the patient, leaving them susceptible to bacterial and viral illnesses, including pneumonia.

A system for inserting and removing a bed pan which eliminates the problems found in the prior systems would be a notable advance in the medical field.

SUMMARY OF THE INVENTION

In accordance with the present invention a novel and useful system for inserting and removing a bed pan is herein provided.

The system of the present invention includes a vessel which is capable of holding human wastes. The vessel is used in conjunction with a bed having a top surface and a bottom surface. The bed may be a conventional bed or a hospital-type bed having portions which elevate or lower either manually or automatically. Thus, the patient, in the latter type bed, is capable of sitting upwardly in the bed due to the raising of a portion of the bed in contact with the shoulder area of the patient.

The system of the present invention also includes a track which extends along and beneath the top surface of the bed. The track is supported by the bed frame or other appropriate parts. The track includes guide means for moving the vessel along the track from the first position within the periphery of the bed to a second position outwardly at the periphery of the bed. The track portion of the guide means may include a pair of U-shaped members which are fastened to the bed by any suitable fastening means. In certain cases, the track of the guide means would lie at the bottom surface of the bed and extend laterally relative to the bed.

A conduit is also employed in the present invention and extends from the top surface of the bed to a place therebeneath. Where the vessel is located at the bottom surface of the bed, the conduit extends from the top surface of the bed to the bottom surface of the bed. The conduit may be constructed in any suitable shape to permit the waste products to travel from the patient downwardly under the influence of gravity. The conduit may also be formed of easily cleanable material such as plastic, metal, and the like. In any case, the conduit may also include the provision of a cover which is preferably formed with a top surface that lies flush with the top surface of the bed. Gripping means may be employed to pull the cover from the conduit when it is to be used. Of course, removal of the cover may be automated by the use of a motor and guide to move the cover laterally relative from the opening of the conduit.

It may be apparent that a novel and useful system for inserting and removing a bed pan has been described.

It is therefore an object of the present invention to provide a system for inserting and removing a bed pan which permits a bed confined person to remain in the bed and use a vessel or bed pan in that position.

Another object of the present invention is to provide a system for inserting and removing a bed pan which allows an attendant to a bed confined person to easily remove and clean a bed pan containing human wastes and to reinsert the same for further use.

Yet another object of the present invention is to provide a system for inserting and removing a bed pan which obviates the need for a bed confined person to manipulate the bed pan for employment of the same.

A further object of the present invention is to provide a system for inserting and removing a bed pan which is easily sanitized.

The invention possesses other objects and advantages especially concerns particular characteristics and features thereof which will become apparent as the specification continues.

Figure 1:
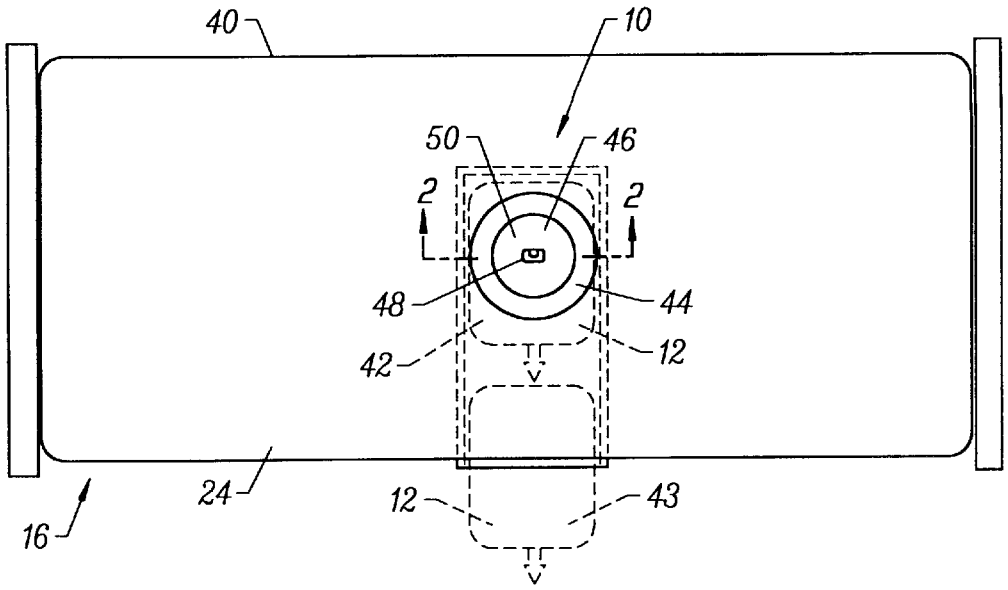
FIG. 1 is a top plan view of the system of the present invention employed in a bed.
Figure 2:
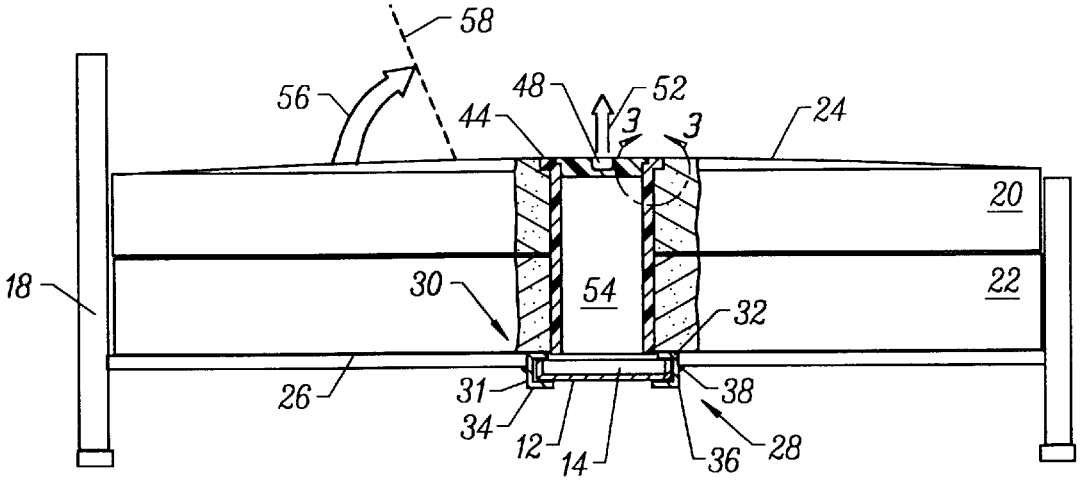
FIG. 2 is a side elevational view of the system of the present invention employed in a bed with a sectional cutout detailing the track and conduit portion of the system.

For a better understanding of the invention reference is made to the following detailed description of the preferred embodiments thereof which should be taken in conjunction with the hereinabove described drawings.

DETAILED DESCRIPTION OF THE PREFERRED EMBODIMENTS

Various aspects of the present invention will evolve from the following detailed description of the preferred embodiments thereof which should be referenced to the prior delineated drawings.

The invention as a whole is illustrated in the drawings by reference character 10. The system 10 includes as one of its elements a vessel 12 which includes an open chamber 14 for holding human wastes. Vessel 12 is used in conjunction with a bed 16 that includes a frame 18 which is typically formed of wood or metal. Frame 18 supports a mattress 20 and a spring structure 22. In certain cases, spring structure 22 would not be used in bed 16. In any case, bed 16 includes a top surface 24 and a bottom surface 26.

Track 28 is also employed in the present invention and extends along and beneath top surface 24 of bed 16. Track 28 includes guide means 30 in the form of slots 31 and 32 of U-shaped members 34 and 36. U-shaped members 34 and 36 are fastened to frame 18 of bed 16 by any suitable means such as screws, bolts, adhesive, and the like. In the present invention, weld point 38 represents the fastening method of the present embodiment. Vessel or pan 12 is slidable within guide means 30.

As is illustrated in the present invention, track 28 lies at the bottom surface 26 of bed 16. With reference to FIG. 1, it may be observed that vessel or pan 12 is movable from a first position within the periphery 40 of bed 16, represented by reference character 42 on FIG. 1. Sliding of vessel or pan 12 places the same outwardly to the periphery 40 of bed 16 into a second position, represented by reference character 44 on FIG. 1.

The invention also employs a conduit 44 which extends from the top surface 24 of bed 16 to a place therebeneath. In then preferred embodiments shown in the drawings, conduit 24 extends to bottom surface 26. Conduit 44 is capable of communicating with chamber 14 of vessel 12 when it is placed in the first position within the periphery 40 of bed 16. In this manner, human waste may pass directly down through conduit 44 to chamber 14 of vessel 12 under the influence of gravity. Conduit 44 may be constructed of any easily cleanable material such as plastic, metal, and the like. Conduit 44 may be retrofitted into existing beds or constructed into newly manufactured beds, as the case may be. Conduit 44 is fitted with a cover 46 provided with a recessed latch 48 on top surface 50 thereof. Thus, cover 46 may be lifted upwardly according to directional arrow 52 to gain access to conduit interior passage 54.

Figure 3:
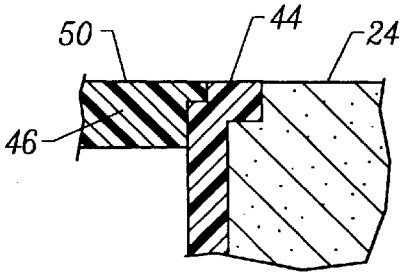
FIG. 3 is a sectional view taken along line 3—3 detailing the flush fitting of the cover portion of the conduit.
Figure 4:
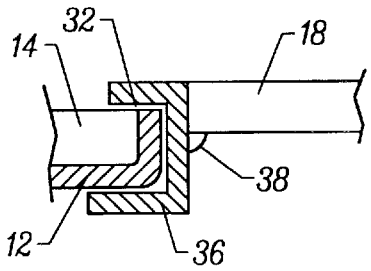
FIG. 4 is a detail showing the fitting of the vessel or pan within the guide means of the present system.

Turning to FIG. 3, it maybe observed that top surface 50 of cover 46 lies flush with top surface 24 of bed 16. It should be understood that sheets and padding normally used with bed 16 must be retrofitted to allow access to passage 54 of conduit 44 by the patient.

In operation, system 10 is fitted within bed 16 either through retrofitting or by newly constructing bed 16 with system 10 in place. Bottom sheets and pads must also contain an opening which allows the patient or person confined to bed 16 to maneuver over conduit 44 and passage 54 thereof. In the case of a typical hospital bed, the patient is elevated upwardly according directional arrow 56 to a plane 58. Cover 46 is removed from conduit 44 according to directional arrow 52. Vessel or pan 12 is moved along track 28 into first position 42 beneath passage 54. After human wastes are passed through passage 54 into pan 12, pan 12 may be removed to second position 44 or completely removed from track 26 for disposal of wastes and cleaning of the pan or vessel 12. Following such sanitizing, vessel 12 is placed again in position one for use in the future. Cover 46 may also be placed over conduit 44 at this time. It should be realized that the movement of vessel or pan 12 may be automated to ease the insertion and removing of the same. Likewise, cover 46 may be automated to move laterally relative to bed 16 for initiation by the patient within bed 16.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A system for receiving and removing waste of a person confined to a bed, having a top surface and a bottom surface supported by a frame, a. a vessel;

b. a track extending along and immediately adjacent to the bottom surface of the bed, said track including guide means for moving said vessel along said track from a first position within the periphery of the bed, to a second position outwardly at the periphery of the bed, said track and guide means comprise a pair of U-shaped members fastened directly to the frame of the bed, said pair of U-shaped members forming a pair of slots accommodating the entire vessel; and c. a conduit extending from the top surface of the bed to a place at and no further than the bottom surface of the bed for communication with the vessel at said first position, without interfering with said moving of said vessel from said first position to said second position.

2. The system of claim 1 which further includes a removable cover fitted over said conduit at the top surface of the bed.

3. The system of claim 2 in which said conduit extends from the top surface of the bed to the bottom surface of the bed.

4. The system of claim 3 in which said cover includes gripping means for exerting a force thereupon.

5. The system of claim 4 in which said cover includes a top surface, said top surface of said cover lying flush with the top surface of the bed.

6. The system of claim 1 in which said pair of U-shaped members are held to the bed by fastening means for attaching said U-shaped membera to the frame of the bed.

* * * * *